US006224823B1

(12) United States Patent
Lindenau et al.

(10) Patent No.: US 6,224,823 B1
(45) Date of Patent: May 1, 2001

(54) COMPACTING AUXILIARY AGENT FOR PRODUCING SINTERABLE SHAPED PARTS FROM A METAL POWDER

(75) Inventors: René Lindenau, Radevormwald; Klaus Dollmeier, Wuppertal; Wieland Kynast, Remschied; Jens Wahnschaffe, Köln, all of (DE)

(73) Assignee: GKN Sinter Metals GmbH & Co. KG, Radevormwald (DE)

( * ) Notice: Subject to any disclaimer, the term of this patent is extended or adjusted under 35 U.S.C. 154(b) by 0 days.

(21) Appl. No.: 09/355,387

(22) PCT Filed: Nov. 18, 1998

(86) PCT No.: PCT/EP98/07406

§ 371 Date: Jul. 27, 1999

§ 102(e) Date: Jul. 27, 1999

(87) PCT Pub. No.: WO99/28069

PCT Pub. Date: Jun. 10, 1999

(30) Foreign Application Priority Data

Nov. 28, 1997 (DE) ..... 197 52 992

(51) Int. Cl.[7] ..... B22F 3/12

(52) U.S. Cl. ..... 419/36; 419/37; 419/38; 419/54

(58) Field of Search ..... 419/36, 38, 54, 419/37

(56) References Cited

U.S. PATENT DOCUMENTS 4,483,905 * 11/1984 Engström ..... 428/570
4,485,182 * 11/1984 Enomoto et al. ..... 501/151
4,540,677 * 9/1985 Enomoto et al ..... 501/151
4,595,558 6/1986 Baldwin et al. .
5,079,198 * 1/1992 Edler et al. ..... 501/98
5,298,055 3/1994 Semel et al. .
5,308,556 * 5/1994 Bagley ..... 264/13
5,328,657 * 7/1994 Kamel et al. ..... 419/36
5,380,179 * 1/1995 Nishimura et al. ..... 419/36
5,432,223 7/1995 Champagne et al. .
5,498,276 3/1996 Luk .
5,624,631 4/1997 Luk .
5,782,954 7/1998 Luk .

FOREIGN PATENT DOCUMENTS 40 03 219 8/1991 (DE) .
0 501 602 9/1992 (EP) .
96/08329 3/1996 (WO) .
99/20689 4/1999 (WO) .

OTHER PUBLICATIONS

Condensed Chemical Dicionary, 10th Ed., pp. 832–832, 1981.*

* cited by examiner

*Primary Examiner*—Daniel Jenkins
(74) *Attorney, Agent, or Firm*—Venable; Gabor J. Kelemen; Marina V. Schneller

(57) ABSTRACT

The invention relates to a process for producing sinterable metallic shaped parts from a metal powder, which is mixed with an auxiliary compacting agent containing at least in part components from the polyalkylene glycol family, is filled into a compacting mold and, following the compacting under pressure, is ejected from the mold as compacted shaped part.

10 Claims, 1 Drawing Sheet

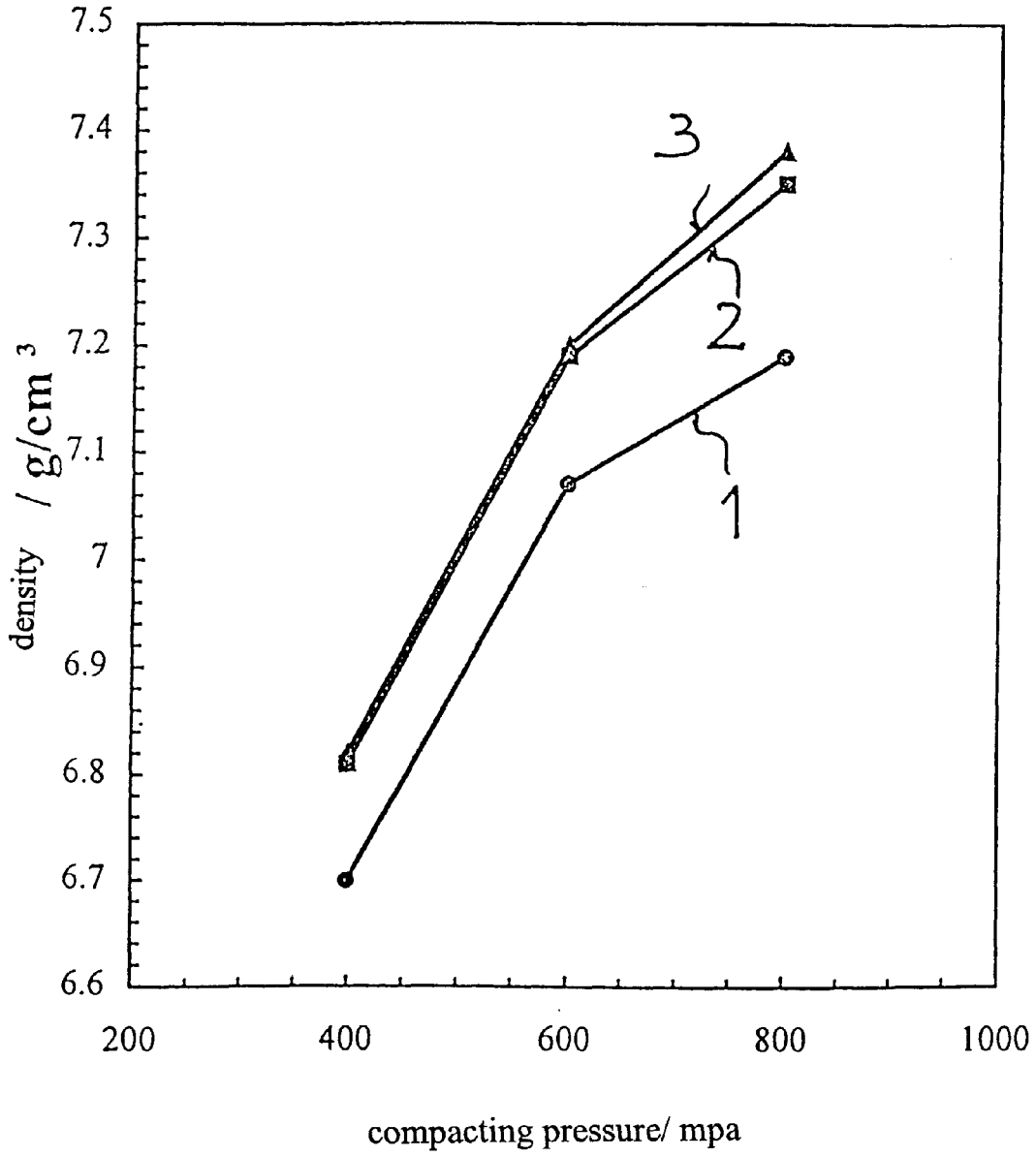
7.5
7.4
7.3
7.2
7.1
7
6.9
6.8
6.7
6.6
density / g/cm 3
200
400
600
800
1000
compacting pressure/ mpa
3
2
1

COMPACTING AUXILIARY AGENT FOR PRODUCING SINTERABLE SHAPED PARTS FROM A METAL POWDER

Description

The problem encountered when producing metallic shaped parts with a powder-metallurgical process is that the shaped parts must be produced with the highest possible density since the metallic powders are initially filled into a mold cavity and are then compacted at high pressure with the aid of single-axle or multi-axle hydraulic or mechanical presses. A shaped part obtained in this way, which is generally referred to as a green compact, is subsequently sintered in a thermal process, mostly in a protective atmosphere, so as to result in a solid, accurately dimensioned metal shaped part.

The density of the finished, sintered shaped part in this case depends essentially on the green compact density that can be achieved. In contrast to the compacting of ceramic powders, the metal powder particles experience a plastic deformation, owing to their different crystalline structure and the number of movable lattice defects connected with this. With metallic powders, the sliding ability of the individual particles relative to each other is reduced as a result of the particle geometry—also in contrast to ceramic powders—so that the loose bulk material in the mold already has a pore volume, which can be removed completely only if extremely high forces are used for the compacting operation. However, high compacting forces result in high wear of the compacting tool during the compacting operation and also lead to increased sliding friction in the mold cavity during the ejection of the completed green compact, so that higher ejection forces with correspondingly increased wear must be generated in this case as well. On the other hand, high ejection forces carry the danger of an undesirable local secondary compacting and the formation of cracks in the green compact.

In order to avoid these disadvantages, a process was suggested in the EP-A-0 375 627, whereby a lubricant that is liquefied with a liquid solvent is added to the metal powder to be compressed. The lubricants suggested for this include metal stearates, particularly lithium stearate or zinc stearate, as well as paraffin products, waxes, natural or synthetic fat derivatives, which are first liquefied, e.g. with organic paraffin solvents as liquid solvent. The disadvantage of this process is that the dry metal powder must initially be mixed with a two-component lubricant system, namely the stearates and the solvents, wherein this preliminary mixture for the most part must be homogeneous. Another disadvantage is that prior to filling the powder mixture into the pressing mold, it must first be preheated to a relatively high heat, up to the range of the softening point for the lubricant used. This entails the danger of baking on while moving through the feeding devices for the mold. Following the completion of the compacting operation and the ejection of the green compact, the lubricant must be vaporized in a separate operation before the green compact can be heated to the actual sintering temperature. In the process, it cannot be avoided that lubricant residues remain in the sintered body, which can also result in disadvantages, depending on the application and the type of pure or alloyed metal powder used.

An iron-based metallurgical powder composition is known from the EP 0 559 987, which contains an organic binder for the iron-based powder components and the alloy powder components. In order to improve the compacting behavior, the organic binder contains a share of polyalkylene oxide, which must have a molecular weight of at least 7000 g/mol. However, considerably higher molecular weights are preferred.

It is the object of the invention to improve the above-described process.

This object is solved with a process for producing sinterable metallic shaped parts from a metal powder, mixed with an auxiliary compacting agent, which contains at least in part components from the polyalkylene oxide family, is filled into a pressing mold and, following the compacting under pressure, is ejected as compressed shaped part from the pressing mold. The use of auxiliary compacting agents containing at least components from the polyalkylene oxide family, particularly polyalkylene glycols and preferably polyethylene oxides, especially in the form of polyethylene glycols, surprisingly showed that the compacting forces required to achieve higher densities and higher green compact strengths are much lower than for other auxiliary compacting agents. The forces needed for ejecting the compacted shaped part from the mold are also clearly reduced, so that the aforementioned disadvantages of the known processes are avoided. Owing to the "lubrication" of the powder particles moving relative to each other during the compacting operation, the powder mixture does not require a special binder since it is possible to achieve a high green compact strength during the compacting operation in addition to the high density, owing to a much higher "packing density" of the powder particles and thus an increase in the direct contact between the metal particles in the powder. A high green compact strength is always desirable if the green compact must be reworked further prior to the sintering. "Metal powder" within the meaning of the invention refers to the powder mixture intended for the production of the shaped part, including all alloying agents and other admixtures, with the exception of the auxiliary compacting agent.

A special advantage of auxiliary compacting agents selected from the family of polyethylene oxides, particularly if these are used in the form of polyethylene glycols, is that the compacting parameters can be influenced through a corresponding selection of the molecular weight, that is to say with respect to the flow properties during the mixing and filling of the mold, as well as with respect to the softening point and thus the temperature control and the material flow during the compacting operation. It is particularly advantageous in this connection if the softening point for the auxiliary compacting agent suggested according to the invention is between 40° C. and 80° C., so that the temperature adjusting at the tool during a continuous compacting operation for the series production as a rule is sufficient to effect a trouble-free "flow" of the powder mixture during the filling of the mold as well as during the compacting. Accordingly, the metal powder with added auxiliary compacting agent can be filled into the mold at room temperature. Particularly for the series production, it may be useful if the compacting tool is heated accordingly to prevent possible interruptions in the series run. A controlled heating of the compacting tools to about 55° C. makes sense, so that the heating caused by frictional heat as well as the cooling caused by interruptions in the operation are taken into account and constant compacting conditions can be specified. The handling of the metal powder is simplified considerably by this, particularly the filling operation because it is possible to work with "cold" powder, meaning powder at room temperature. A baking on, lump formation and the like cannot occur since the metal powder with mixed-in auxiliary compacting agent is heated only in the mold. An additional preheating of the powder may be advisable for extremely large volume particles.

The low softening temperature additionally has the advantage that immediately after the filling operation, the shares of auxiliary compacting agent in the metal powder, which make contact with the heated mold walls, are initially warmed to the softening temperature. Thus, during the subsequent compacting operation, the relative movements occurring at the tool wall between powder filling and compacting tool are already "lubricated" and the friction in these regions is reduced. During the following operation where total compacting pressure is applied, the complete powder filling is subsequently heated past the softening point as a result of the compacting pressure. Thus, even the internal and relatively high relative movements in the metal powder filling, which result from the particle geometry of the metal powder, are made easier by the effect of the auxiliary compacting agent with lubricating effect. Owing to the deformation of the powder particles and the resulting increase in the packing density, a portion of the auxiliary compacting agent in the free-flowing state is additionally pushed toward the edge region, thereby resulting in a considerable reduction in the friction between the finished green compact and the mold cavity wall during the ejection of the green compact. Thus, the softening temperature of the auxiliary compacting agent must be adjusted such that by taking into account the operating temperature during the compacting operation, the outside surfaces of the green compact are not "moistened" by the auxiliary compacting agent, so as to prevent loose particles from adhering.

The mixing with the metal powder does not result in disadvantages, even at low molecular weights. The mixing operation can be influenced within specific limits through the selection of the auxiliary compacting agent and/or a mixture of auxiliary compacting agents with corresponding molecular weight. Surprisingly, it has turned out that on the one hand polyethylene oxide can be mixed uniformly with metal powders, even at very low molecular weights and small weight shares while, on the other hand, it is possible to achieve a good "flowing" of the powder mixture during the mold filling.

The auxiliary compacting agent can be mixed "cold" into the metal powder, meaning at room temperature. However, a warm mixing of the auxiliary compacting agent with the metal powder is particularly useful, e.g. in a heated drum mixer with subsequent cooling and simultaneous agitation. In that case, the temperature of the mixer is initially adjusted to be somewhat higher than the softening temperature predetermined for the compacting operation. It makes sense if the mixing temperature is 50–100° C., preferably 85° C. Following the cooling down, a pourable powder mixture is then available, which ensures an easy handling during the filling of the mold.

With a liquid consistency of the auxiliary compacting agent, an additional reduction in the viscosity is possible by adding a solvent, so that the powder particles can be provided with an even thinner coating of the auxiliary compacting agent, in a process that is comparable to the spray drying process. Suitable solvents include, in particular, alcohols such as ethanol, isopropanol, or benzyl alcohol, which evaporate quickly after the spraying, so that the resulting powder mixed with auxiliary compacting agent is "dry" and the required pourability or flowability for filling into the mold is maintained.

One advantageous embodiment of the invention provides that the mixture contains a share of up to 5 weight % of the auxiliary compacting agent, relative to the share of metal powder. In that case, advantageous use is made of the fact that the density of the auxiliary compacting agent according to the invention is higher than the density of traditional auxiliary compacting agents. Thus, given the same weight share, the space factor for the auxiliary compacting agent is adjusted lower and the space factor for the compacted metal powder is consequently adjusted higher. It makes sense to use an auxiliary compacting agent share of no more than 1 weight %, relative to the metal powder.

The auxiliary compacting agent in the form of polyalkylene glycol, especially in the form of polyethylene glycol, is selected such that it has a softening point between 40° and 80° C. The use of polyethylene glycol products with molecular weights between 100 g/mol and 6500 g/mol, preferably 3000 to 6000 g/mol, has proven to be advantageous. It makes sense in this case to use mixtures of polyethylene glycol with different molecular weights which, however, in the mixture should approximately correspond to the total molecular weight.

The hydroxyl number for the auxiliary compacting agent can range between 500 and 700, while the density can range between 0.9 and 1.25 g/cm$^3$.

By mixing polyethylene glycols with various molecular weights, it is possible to purposely arrive at an auxiliary compacting agent, which can be adapted exactly to the compacting process used with respect to mixing qualities, softening point and lubricating properties.

The herein-suggested auxiliary compacting agent can be characterized with the following total formula:

$$H\text{—}[\text{—}O\text{—}CH_2\text{—}CH_2\mathbf{13}\,]_n\text{—}OH$$

The increases in the compacting densities that can be achieved with the herein specified auxiliary compacting agent do not primarily result from a temperature-dependent change in the physical properties of the metal powder, as for the process described in the EP-A-O 375 627. These increases are essentially due to an improvement in the lubricating behavior of the powder to be compacted, particularly between the mold cavity wall and the powder filling, given a respective temperature control at the compacting tools. Another advantage of the auxiliary compacting agent suggested herein is that it can be eliminated easier thermally prior to the sintering, e.g. through diffusion processes, the escape via capillary forces, sublimation, evaporation or the like. In this connection, the auxiliary compacting agent according to the invention also distinguishes itself by an environmentally acceptable disposal option since it can be separated into water vapor and carbon dioxide in a pyrolysis.

Surprisingly, it has turned out that an auxiliary compacting agent consisting of a mixture of a traditional amide wax, present as a hard and extremely brittle powder, with a polyethylene glycol having a molecular weight of more than 7000 g/mol also leads to excellent compacting results and an easy ejectability of the green compact from the mold. A "wetting" of the outside surfaces is avoided with certainty in that case. The share of polyethylene glycol in the auxiliary compacting agent mixture in this case can be considerably below 40%. Ethylene pis-stearoylamide can be used here as amide wax.

Metal stearates, particularly lithium stearate or zinc stearate as well as paraffin products, waxes, natural or synthetic fat derivatives were used until now as lubricants to reduce the friction between mold cavity wall and powder particles on the one hand and between powder particles on the other hand. For newer developments, multi-component, high-temperature resistant (meaning in this case approximately 130° C.) lubricants are used, which thus cause a reduction of the yield strength of the metal to be compacted and consequently lead to higher compacting densities, as previously described in the EP-A-O375 627. The following diagram shows a comparison of the moldability according to various processes, conventional compacting at room temperature, so-called warm compacting as described in the EP-A-O 375 627, and the process according to the invention.

One experiment uses a water-atomized iron powder containing 2% copper and 0.6% carbon, respectively in the form of a powder. The curves schematically illustrate the dependence of the density on the compacting pressure.

The curve 1 as reference curve shows the result when using a cold-compacting process with a traditional lubricant in the form of an amide wax or a microwax, e.g. ethylene pis-stearoylamide.

The curve 2 shows the result when using a warm-compacting process according to prior art. A clear improvement is already noticeable in this case. However, the previously described disadvantages must be taken into account here.

The curve 3 finally shows the result if the process according to the invention is used, which leads to an even clearer increase in the final density.

The following tables list green densities and green strengths that can be achieved in dependence on the compacting pressure by contrasting the results, obtained when subjecting a metal powder with auxiliary compacting agent to different compacting pressures during different mixing processes.

TABLE 1

| Compacting pressure mpa | Mixing operation | Compacting operation | Density in g/cm$^3$ | Green compact strength in the 3-point bending test N/mm$^2$ |
|---|---|---|---|---|
| 400 | cold | cold | 6.68 | 10.50 |
| 600 | cold | cold | 7.07 | 13.40 |
| 800 | cold | cold | 7.14 | 16.80 |

TABLE 2

| Compacting pressure mpa | Mixing operation | Compacting operation | Density in g/cm$^3$ | Green compact strength in the 3-point bending test N/mm$^2$ |
|---|---|---|---|---|
| 400 | warm | cold | 6.80 | 14.30 |
| 600 | warm | cold | 7.22 | 20.80 |
| 800 | warm | cold | 7.35 | 22.20 |

TABLE 3

| Compacting pressure mpa | Mixing operation | Compacting operation | Density in g/cm$^3$ | Green compact strength in the 3-point bending test N/mm$^2$ |
|---|---|---|---|---|
| 400 | cold | warm | 6.85 | 23.10 |
| 600 | cold | warm | 7.24 | 34.10 |
| 800 | cold | warm | 7.33 | 35.80 |

TABLE 4

| Compacting pressure mpa | Mixing operation | Compacting operation | Density in g/cm$^3$ | Green compact strength in the 3-point bending test N/mm$^2$ |
|---|---|---|---|---|
| 400 | warm | warm | 6.88 | 25.60 |
| 600 | warm | warm | 7.28 | 37.40 |
| 800 | warm | warm | 7.37 | 38.30 |

TABLE 5

| Compacting pressure mpa | Mixing operation | Compacting operation | Density in g/cm$^3$ | Green compact strength in the 3-point bending test N/mm$^2$ |
|---|---|---|---|---|
| 400 | cold | cold | 6.75 | 5.40 |
| 600 | cold | cold | 7.07 | 6.70 |
| 800 | cold | cold | 7.12 | 6.80 |

For the above mentioned metal powder, Table 1 shows a content of 0.6 weight % of polyethylene glycol with a mol weight in the range of approximately 6000 g/mol, which is mixed and also compacted cold, meaning at room temperature. The table shows a nearly proportional increase of the green density and the green strength to the compacting pressure.

In Table 2, the result for a starting material with the same composition is shown. However, the material was warm-mixed and cold compacted. In addition to an increase in the green density, a clear increase in the green strength is shown here as compared to the values for the cold compacting of a cold-mixed powder. Using a mixing temperature in the range of the upper limit of the softening temperature for the compacting agent, or slightly above it, clearly results in a better distribution in the mold cavity for the powder and thus a thinner "lubricant film," which favors the sliding movements of the powder particles and thus also the "contact density" of the metal particles and the "interlocking" made possible by this.

Table 3 shows the values for a cold-mixed powder that is warm-compacted. The achievable values for the green density correspond to the aforementioned values, while the green strength shows a clear increase, which demonstrates the interconnection between the type of polyethylene glycol with low molecular weight that was used and the temperature control during the compacting.

Table 4, on the other hand, shows a further increase in the green density for a warm-mixed powder that is warm-compacted, wherein nearly the maximum possible density near the density of solid iron is reached for a compacting pressure of 800 mpa. Particularly noticeable in this case, however, is the further increase in the green strength. The green strength was determined with a so-called 3-point bending test. The indicated values respectively designate the specific applied load on the surface, for which a break occurs in the green compact.

The improvement in the green density that is displayed in the preceding tables, particularly also the green strength, is probably due to the use of a polyethylene glycol with a molecular weight of less than 7000 g/mol. Critical in this case is the increase in the green strength occurring during the warm-mixing, which is probably due to the fact that during the warm-mixing, the iron-powder particles, the copper particles and the carbon particles are coated with an extremely thin coating of the auxiliary compacting agent.

This is obvious from the fact that with a warm-mixed powder, the aforementioned composition of the carbon powder to be mixed in does not create any dust and, as compared to the cold-mixed powder, does not stick to the finger during a "finger test." A test of the distribution of the alloy powder shares copper and carbon showed a homogeneity, which corresponds to the homogeneity of a diffusion-alloyed metal power. A metal powder is shown herein, for which initially the iron powder and the powdered alloy components are mixed and the mixture is then pre-treated thermally to allow the alloy powder to bind to the iron powder, so that a separation is avoided. The auxiliary compacting agent is only mixed in after that, during an additional operational step.

The experiments demonstrate that the energy-intensive thermal pre-treatment of the powder mixture can be omitted with the process according to the invention, simply because the powdery alloy components are bonded inseparably and with good homogeneity to the iron particles with the aid of the auxiliary compacting agents, especially during the warm-mixing process. This also clearly demonstrates the advantage of the invention.

The increase in the green strength is probably due to the improved flow behavior under pressure and temperature of the auxiliary compacting agent with relatively low molecular weight in the metal powder mold cavity. This is due to the fact that a much higher frequency of direct contact between metallic surfaces of the individual metal particles on the one hand occurs because of the extremely homogeneous mixture of auxiliary compacting agent and metal powder and, on the other hand, because of the thin "lubricant agent film" that forms during the mixing and which is further reduced during the warm-pressing, thus making it possible to achieve the initially described plastic deformation and interlocking of the metal powder particles.

In contrast to Table 2, somewhat higher values surprisingly resulted for an auxiliary compacting agent mixture of amide wax having a share of approximately 40% of a polyethylene glycol with a molecular weight of more than 6000 g/mol, which was warm-mixed into the metal powder that was subsequently warm-compacted.

Table 5 shows as reference the values for the metal powder, into which an amide wax is cold-mixed and which is cold-compacted.

What is claimed is:

1. A process for producing sinterable, metallic shaped parts from a metal powder mixed with an auxiliary compacting agent, which contains at least in part components from the family of polyethylene glycols having a molecular weight of between 100 and 6,500 g/mol and which is filled into a compacting mold and, after being compacted under pressure, is ejected as a compacted shaped part from the mold.

2. A process according to claim 1, characterized in that the auxiliary compacting agent share present in the mixture is up to 5 weight %, preferably less than 1 weight %, relative to the metal powder share.

3. A process according to claim 1, characterized in that the auxiliary compacting agent has a softening point between 40° C. and 80° C.

4. A process according to claim 1, characterized in that the auxiliary compacting agent has a molecular weight of between 3000 and 6000 g/mol.

5. A process according to claim 1, characterized in that the auxiliary compacting agent comprises less than 40% polyethylene glycol.

6. A process according to claim 1, characterized in that the auxiliary compacting agent has a hydroxyl number of 5 to 700.

7. A process according to claim 1, characterized in that the auxiliary compacting agent has a density of 0.9 to 1.25 $g/cm^3$.

8. A process according to claim 1, characterized in that the metal powder mixed with the auxiliary compacting agent is filled into the compacting mold at a temperature below the softening point of the auxiliary compacting agent used, so that the auxiliary compacting agent is softened by energy introduced into the compacting mold during at least one step of the process, wherein the at least one step includes the compacting (warm-pressing).

9. A process according to claim 1, characterized in that the metal powder mixed with the auxiliary compacting agent is filled into the compacting mold at a temperature below the softening point for the auxiliary compacting agent used and is compacted without supplying additional energy during the compacting (cold-pressing).

10. A process according to claim 1, characterized in that the auxiliary compacting agent is mixed into the metal powder at a temperature which is at least in the range of the softening point for the auxiliary compacting agent (warm-mixing).

* * * * *

UNITED STATES PATENT AND TRADEMARK OFFICE

CERTIFICATE OF CORRECTION

PATENT NO. : 6,224,823 B1
DATED : May 1, 2001
INVENTOR(S) : René Lindenau et al.

It is certified that error appears in the above-identified patent and that said Letters Patent is hereby corrected as shown below:

Title page,
Item [75], line 3, the city should read: -- Remscheid --.
Item [30], the serial number should read: -- 197 52 993 --.

Signed and Sealed this

Twenty-second Day of January, 2002

*Attest:*

*Attesting Officer*

JAMES E. ROGAN
*Director of the United States Patent and Trademark Office*